US006431406B1

(12) United States Patent
Pruett

(10) Patent No.: US 6,431,406 B1
(45) Date of Patent: Aug. 13, 2002

(54) COLLAPSIBLE CONTAINER

(76) Inventor: Nicolas Roger Pruett, 1039 Kaalula Pl., Honolulu, HI (US) 96825

( * ) Notice: Subject to any disclaimer, the term of this patent is extended or adjusted under 35 U.S.C. 154(b) by 0 days.

(21) Appl. No.: 09/770,483

(22) Filed: Jan. 29, 2001

(51) Int. Cl.[7] ..... B65D 35/00
(52) U.S. Cl. ..... 222/210; 222/475; 220/666; 215/900
(58) Field of Search ..... 222/92, 156, 475, 222/210; 220/756, 666, 672, 907, 667; 215/900

(56) References Cited

U.S. PATENT DOCUMENTS 2,098,858 A * 11/1937 Busson et al. ..... 220/38
3,471,058 A * 10/1969 Latham et al. ..... 222/92
3,875,941 A * 4/1975 Adair ..... 128/278
4,044,836 A * 8/1977 Martin et al. ..... 169/30
4,157,103 A * 6/1979 La Fleur ..... 141/98
4,456,134 A * 6/1984 Cooper ..... 215/12
4,592,492 A * 6/1986 Tidmore ..... 222/209
4,898,306 A * 2/1990 Pardes ..... 222/206
5,417,347 A * 5/1995 de LaForcade ..... 222/95
5,562,221 A * 10/1996 Beniacar ..... 215/386
5,667,101 A * 9/1997 Barrash et al. ..... 222/92
5,873,492 A * 2/1999 Sullivan ..... 222/105
5,913,448 A * 6/1999 Mann et al. ..... 220/666
5,941,866 A * 8/1999 Niedospial, Jr. ..... 604/408
5,979,326 A * 11/1999 Ohinata ..... 101/494
6,047,848 A * 4/2000 Davis ..... 220/666

* cited by examiner

*Primary Examiner*—Kevin Shaver
*Assistant Examiner*—Frederick C Nicolas

(57) ABSTRACT

A collapsible container is disclosed having a top portion and base portion joined by a midsection of undulating walls of accordion style which allows for the axial compression and expansion of the container. A U-shaped handle is also disclosed which provides for grasping of the container, provides axial stability when the container is in its fully expanded form, secures the container in its fully collapsed form, and protects the container's closure mechanism.

1 Claim, 4 Drawing Sheets

COLLAPSIBLE CONTAINER

REFERENCES CITED

| | | |
|---|---|---|
| 4,044,836 | 8/1977 | Martin, et al. |
| 4,157,103 | 6/1979 | La Fleur |
| 4,187,960 | 2/1980 | Bonk |
| 4,213,933 | 7/1980 | Cambio |
| 4,256,789 | 3/1981 | Suzuki, et al. |
| 4,428,567 | 1/1984 | Sneider |
| 4,456,134 | 6/1984 | Cooper |
| 4,526,296 | 7/1985 | Berger, et al. |
| 4,610,366 | 9/1986 | Estes, et al. |
| 4,775,564 | 10/1988 | Shriver, et al. |
| 4,790,361 | 12/1988 | Jones |
| 5,447,110 | 9/1995 | Brown |
| 5,553,745 | 9/1996 | McMillian |
| 5,615,791 | 4/1997 | Vatelot |
| 5,667,101 | 9/1997 | Barrash, et al. |
| 4,955,493 | 9/1990 | Touzani |
| RE36,377 | 11/1999 | Gilbert |
| 6,047,848 | 4/2000 | Davis |
| 6,116,488 | 9/2000 | Fragos |

DESCRIPTION OF PRIOR ART

Several containers have been provided in former art which present with collapsible walls. Examples of prior art which present with collapsible midsections include U.S. Pat. No. 4,775,564, which was issued Oct. 4, 1998 to Shriver, Clinton, Richeson, Canton, Vogliano, Tallmage, U.S. Pat. No. 36,377, which was reissued Nov. 9, 1999 to Neil Y. Gilbert, and U.S. Pat. No. 5,174,458, which was issued Dec. 29, 1992, Umberto D. I. Segati. In each example the inventions are improved upon in that the disclosed invention provides a means of handling the container, provides for axial support of the container in expanded form, and provides for a means of supporting and retaining the container in collapsed form. These improvements are attributable to a handle which is affixed to create a graspable, rigid spine when the container is in the expanded form. This also discloses the handle wherein it is affixed to prevent the axial expansion of the container when it is in its collapsed form.

Another form of collapsible container is disclosed in U.S. Pat. No. 6,047,848, which was issued Apr. 11, 2000 to Rex C. Davis. That patent disclosed a container with a collapsible midsection and a locking means to retain the container in the collapsed form. As in the case of the other examples of prior art, the retention of the Davis invention in its expanded form is directly dependent on the material of the flexible walls of the container having a thickness to normally enable self support of the container. The disclosed invention improves on the Davis invention in that the support of the container is supplemented by the disclosed handle. This provision allows for flexibility in materials used in construction and a reduction in wall thickness in appropriate instances.

Another improvement noted over the Davis invention in that the position of the handle in the disclosed invention provides for increased ease of handling of the container when dispensing solutions.

The disclosed invention presents with a flush profile of its top portion when in its fully collapsed and secured form. This flush profile is an improvement on the Davis invention in that projections, such as the securing cap, U-shaped top channel clamp, and vent cap disclosed in the David invention, are eliminated. The elimination of these projections increases packaging efficiency in stacking and storing units during transport, while the containers are being displayed for sale, and while being stored by the end user. An additional improvement attributable to the flush top surface of the disclosed invention is the provision for usable space on which product information can be placed without the need for secondary packaging.

Yet another improvement on prior art which this invention provides for is an increased level of product and consumer protection. The inadvertent displacement of a storage container's closure device is the most common mode of introducing contaminants into a container. In addition to providing a grasping means for the user, and a rigid support for the container is in its fully expanded form, this invention's handle secures the container closed in such a way as to fully protect the container's closure cap. The potential inadvertent displacement of the closure device from the container, and the introduction of contaminants through this route, is thereby substantially reduced.

Examples of prior art, which support methods of production for the disclosed main body of the invention, include U.S. Pat. No. 4,187,960, which was issued Feb. 12, 1980 to Bonk, and U.S. Pat. No. 4,213,933, which was issued Jul. 22, 1980 to Cambio. In both examples, a blow molding technique for plastics is disclosed. The main body of the disclosed invention may be produced in a plural cavity, two sided, blow mold format as referred to in U.S. Pat. No. 4,213,933, June 1980, Cambio.

BACKGROUND OF THE INVENTION

This invention relates to a collapsible container which is used for storing products requiring the addition of liquids prior to use. The collapsible container presents in two functional states. In a fully collapsed form, the collapsible container is used for the storage of evaporated, powdered, condensed, or concentrated products. In a fully expanded form, the collapsible container stores the evaporated, powdered, condensed, or concentrated products in a solution form. In addition, in a fully expanded form, the collapsible container functions as the mixing device and dispensing container for the products in solution form.

The packaging of products in evaporated, powdered, condensed, and concentrated forms provides for increased efficiency in the storage and distribution of the products. The increased storage and distribution efficiency is predominantly associated with decrease container size requirements. Additional benefits noted relate to increased product shelf life, and maintained product quality associated with evaporated, powdered, condensed, and concentrated products.

The preparation of the evaporated, powdered, condensed, and concentrated products to a usable form typically involves the use of secondary containers into which the products are dispensed, appropriate liquids are added, in which the products and liquids are brought into solution, and from which the liquids are dispensed. To bring the products and the added liquids into a usable solution, supplemental mixing devices, such as spatulas or long handled mixing spoons, are often required.

This invention eliminates the need for secondary containers and supplemental mixing devices while improving upon present packaging for evaporated, powdered, condensed, and concentrated products.

The invention eliminates the need for secondary storage and dispensing containers, as the collapsible container forms a functional pitcher-like storage and dispensing container when in its fully expanded form. The ability of the collapsible container to expand is attributable to the undulating accordion style walls or corragated walls of the collapsible container's midsection and to the material type used. A pitcher-like form is attained when opposing forces are placed along the long axis of the container. The opposing forces lead to the elongation of the midsection and a corresponding increase of the container's overall vertical dimension. The material types which would allow for this action and associated forces may be selected from metal foils, polymers, elastomers, plastics, and paper based products. When the inventions multi-functional U-shaped handle is attached, the collapsible container takes on the form of a functional pitcher.

Supplemental mixing devices are eliminated as mixing of the added liquids and evaporated, powdered, condensed, or concentrated products is undertaken by briskly shaking the container until the desired solution consistency is reached. The undulating accordion style walls of the container's collapsible midsection assists with the incorporation of the added liquid and the stored product by acting as a resistance form.

Consumers appreciate time, money, and energy savings as the need to purchase, use, store and clean secondary storage containers and supplemental mixing devices is eliminated.

In its fully collapsed form the invention is generally cubical in nature. This feature provides for increased efficiency in storage and bulk packaging of multiple units both from a manufacturing and retail standpoint when compared to exiting packaging forms.

A specific example where the general cubical configuration of the collapsible container will be a distinct improvement is in its use with frozen juice concentrates. Present container systems for frozen juice concentrate are typically cylindrical. The cylindrical shapes of the existing containers are inefficient in terms of space use, are unstable when stacked, and are difficult to handle. The generally cubical nature of this invention provides for efficient space use as the containers may be placed in direct contact with one another in a consistent manner. In addition, this invention provides for stability when stacking, and the physical handling characteristics are far greater than those of cylindrical form.

When compared to the cylindrical container form of frozen juice concentrate containers, an additional benefit attributable to the generally cubical form comes in the form of an increase in readily visible surface area. This feature allows for additional surface area for the presentation of product information and display advertising by the manufacturer.

This invention's most unique feature, when compared to existing storage devices and previous art, is its U-shaped handle. The U-shaped handle performs the function of being a means by which secure the container closed and protect its closure cap, provides a method by which to grasp the container, and is the dominant means by which the container is supported both in its fully expanded and fully collapsed forms.

In its fully expanded form, the U-shaped handle forms a rigid supporting spine. This feature improves upon existing storage devices and existing art in that the retention of the expanded form is no longer strictly dependent on the self-supporting characteristic of the materials used to form the walls of the container. The handle's U-shaped action as a supporting spine or bight therefore allows for a diversity in materials types and material thickness to be used in construction of the container's body. In addition to forming a rigid supporting spine, or bight the U-shaped handle acts as a functional means by which to grasp the container when the container is in its fully expanded form.

Yet another improvement on existing storage devices and prior art which this product provides for is an increased level of product and consumer protection. The inadvertent displacement of a storage container's closure device is the most common mode of introducing contaminants into a container. When the invention's U-shaped handle secures the container in its fully collapsed form, the container's closure cap is fully covered by the U-shaped handle, making access to the closure cap possible only upon displacement of the handle. The potential inadvertent displacement of the closure device from the container, and the introduction of contaminants through this route, is substantially reduced.

In its fully collapsed form, the collapsible container is inherently rigid and can withstand stresses which surpass existing single walled, non-collapsible container types. In its collapsed forms the undulating walls of accordion style or corrugated style compress to form a wall which is the thickness of one plain of the accordion fold. With the accordion folds starked upon one another, the sides of the container are particularly resistant to damage from lateral impacts. While in its fully collapsed form the U-shaped handle acts to further protect the container from lateral impact and provides a resistance form to vertical compression.

DESCRIPTION OF PREFERRED EMBODIMENT

The presently preferred best mode for carrying out the present invention is illustrated by way of FIGS. 1 to 4.

Figure 1:
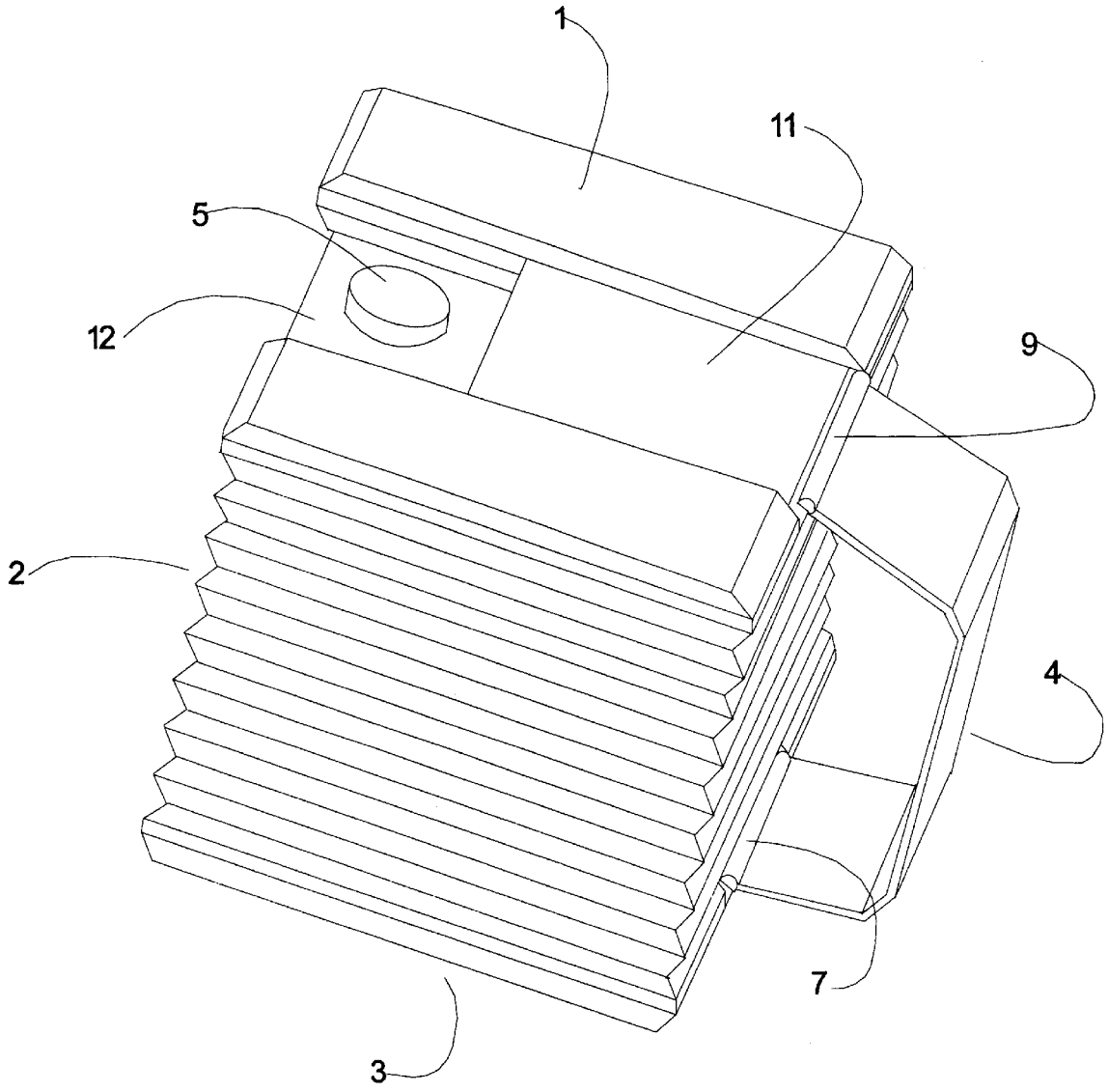
FIG. 1. is a side schematic elevated view of the container in its fully expanded form. Shown are the following components: rectangular top portion (1); collapsible rectangular midsection in its fully expanded form (2); rectangular base portion (3); U-shaped handle (4) locked into rear of the top rectangular portion (1) and into the rear of the rectangular base portion (2) to accommodate securing the container in its fully expanded form; threaded cap (5) secured in place; U-shaped handle inset or recess (11); cap inset or recess 12.

The best mode of carrying out the invention would present with a main body, as illustrated in FIG. 1, which consists of a top rectangular portion (1), a collapsible rectangular midsection (2), and a base rectangular portion (3). The top portion (1), collapsible midsection (2), and base portion (3,) form a hollow, four-walled container with a base and a top. The top portion (1) has solid walls, which continue to the collapsible midsection (2), which in turn continues to form the base portion (3), which then terminates in a solid walled base.

Figure 2:
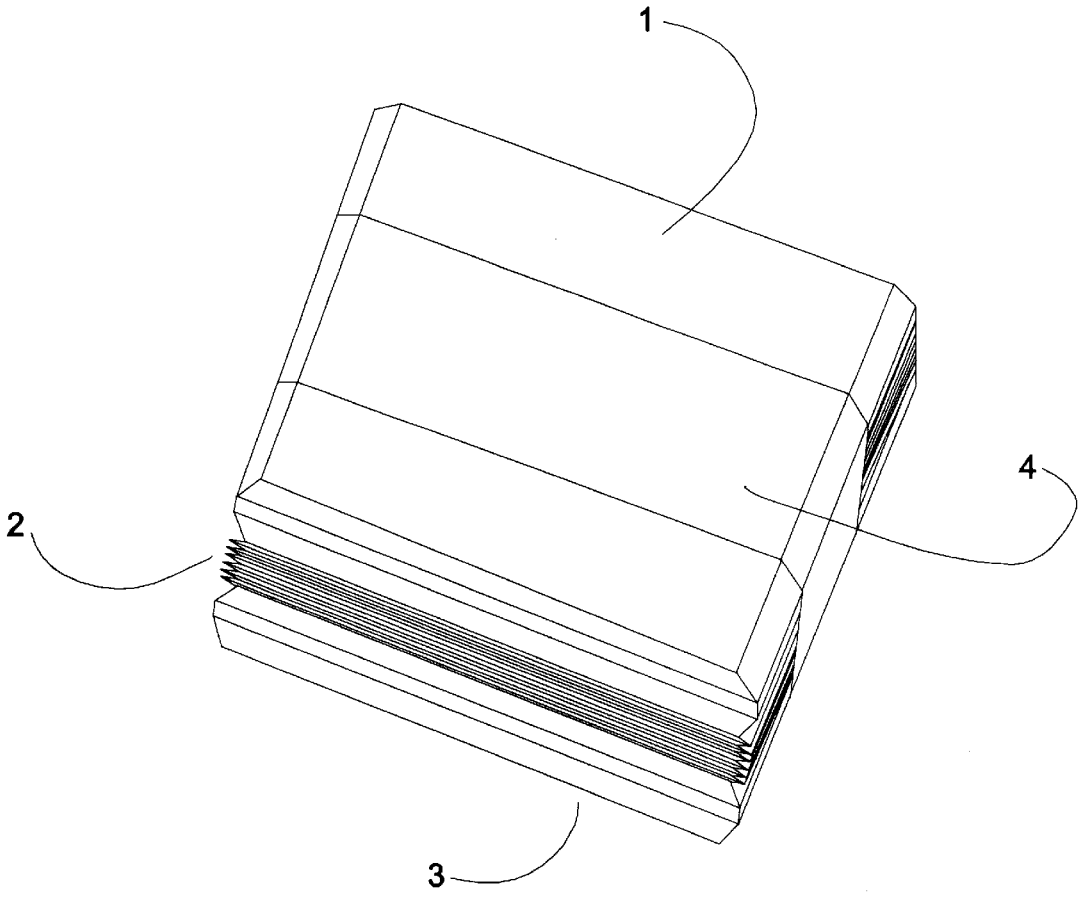
FIG. 2. is a side schematic elevated view of the container in its fully collapsed form. Shown are the following components: top rectangular portion (1); collapsible rectangular midsection in its fully collapsed form (2); rectangular base portion (3); U-shaped handle (4) locked in place to accommodate securing the container in its fully collapsed form.

The collapsible container presents with a fully collapsible and fully expandable form. The collapsible midsection, formed of undulating walls of accordion style, provides for both forms. Referring to FIG. 1, the collapsible container is presented in its fully expanded form, wherein the collapsible midsection (2) is in its fully expanded form. Referring to FIG. 2, the container is in its fully collapsed form wherein the collapsible midsection (2) is in its fully collapsed form.

The ability of the collapsible midsection to transform from a fully collapsed state to a fully expanded state is attributable to the mechanical characteristics of the undulating walls of accordion style and material types used in construction. The material type used in the construction of the midsection must therefore possess the characteristics of being reasonably able to withstand stresses associated with the axial mechanical expansion and compression forces necessary to transform from one to the other state. Material types which would accommodate this requirement may be selected from metal foils, polymers, elastomers, plastics, and paper based products.

In its use as a storage container for solutions, the characteristics of the main body of the container would include a reasonable degree of fluid impermeability. The material type used in construction of the container will vary to accommodate the storage requirements of the stored products in their evaporated, powdered, condensed, and concentrated forms as wells as in their respective final solution forms. Material types which would accommodate this requirement may be selected from metals, metal foils, polymers, elastomers, plastics, and paper based products. The ideal material type to be used would have the additional characteristic of being recyclable.

To minimize material waste in the construction of the collapsible container the overall size of the container will vary to accommodate product requirements. Referring to FIG. 1, the base portion (3) of the product is sized to minimally contain products in their evaporated, powdered, condensed, and concentrated forms. The collapsible midsection (2) is sized to minimally to contain the added liquid to bring the above mention products in solution. The top portion (1) is designed to provide housing of the handle (4) and the threaded cap (5). The container is designed to provide a minimal profile both in its fully collapsed and fully expanded forms.

Figure 3:
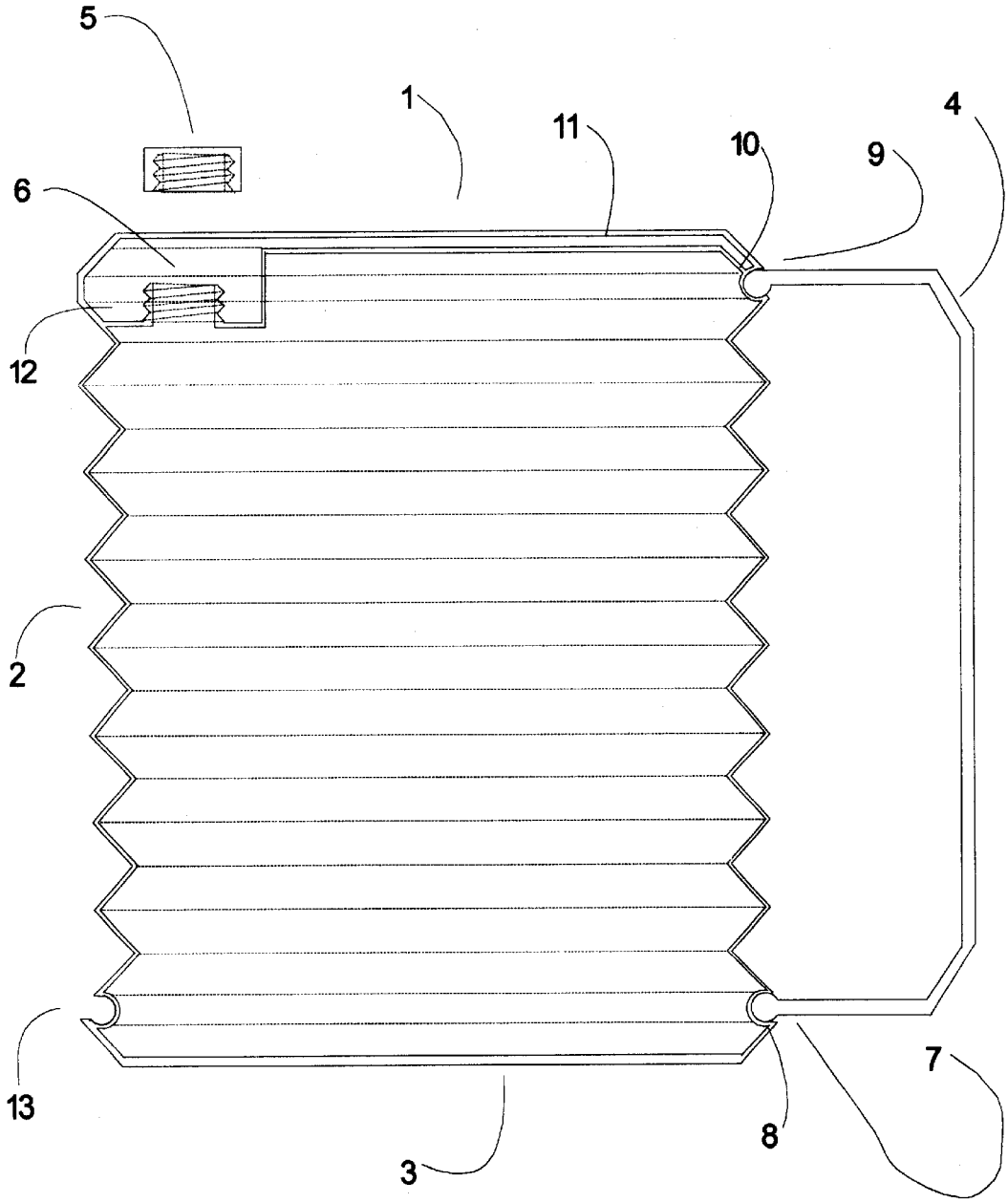
FIG. 3. is a cross-sectional schematic view of the side of the presently preferred embodiment of the storage container; the cross-section passes along the middle plane from the back through the front of the container. The collapsible container is shown in its fully expanded form wherein the U-shaped handle (4) is connected via the male handle connector mechanism or bead on the handle base (7) to the female handle connector mechanism or groove on the base portion rear side (8). In addition, the male handle connector mechanism or bead on the handle top (9) is attached to the female handle connector mechanism or groove on the top portion rear side (10). The threaded cap (5) is shown detached from the threaded inlet (6). Other components shown are include: rectangular top portion (1); collapsible midsection in its fully expanded form (2); rectangular base portion (3); handle inset or recess (11); cap inset or recess (12); female handle connector mechanism or groove on the base portion front side (13).
Figure 4:
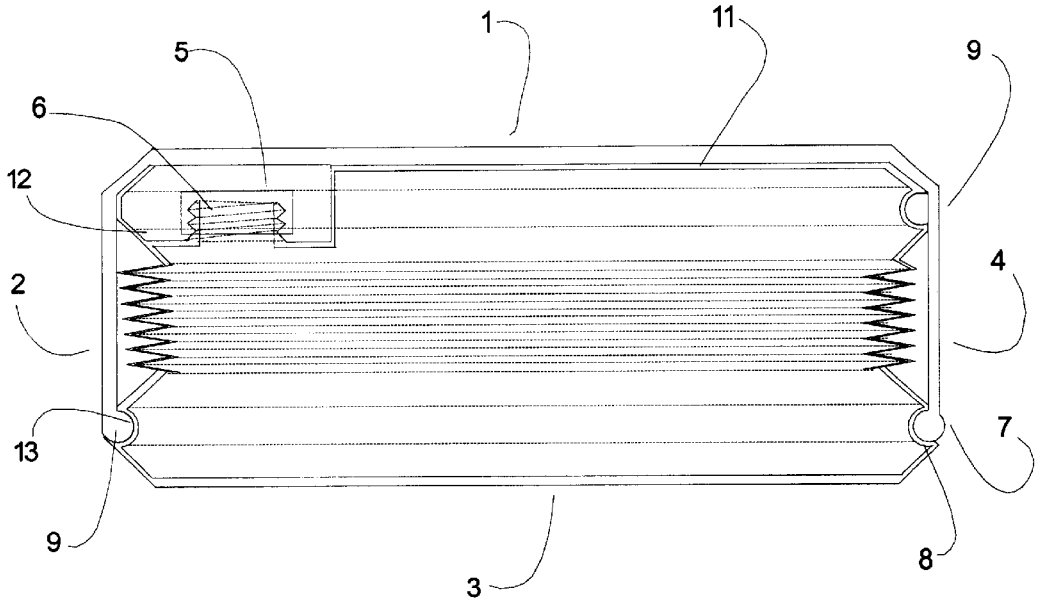
FIG. 4. is a cross-sectional schematic view of the side of the presently preferred embodiment of the storage container; the cross-section passes along the middle plane from the back through the front of the container. The collapsible container is shown in its fully collapsed form wherein the U-shaped handle (4) is connected via the male handle connector mechanism or bead on the handle base (7) to the female handle connector mechanism or groove on the base portion rear side (8). In addition, the male handle connector mechanism on the handle top (9) is attached to the female handle connector mechanism on the base portion front side (13). The threaded cap (5) is shown attached to the threaded inlet (6). The U-shaped handle (4) is shown resting in the handle inset or recess (11). Other components shown are: rectangular top portion (1); collapsible rectangular midsection (2); rectangular base portion (3); cap inset or recess (12); female handle connector mechanism or groove on the rectangular top portion rear side (10).

The transformation of the collapsible container from its fully collapsed form, as shown in FIG. 2, to its fully expanded form, as shown in FIG. 1, is best illustrated in the following manner:

Referring to FIG. 4, detach the male handle connector mechanism or bead on the handle top (9) from the female handle connector mechanism or groove on the base portion front side (13); swing the handle (4) over the top portion (1) such the handle clears the top portion (1); partially detach the threaded cap (5) from the threaded inlet (6) to allow for relief of the vacuum within the container; place simultaneous opposing forces on the top portion (1) and the base portion (3) of the container such that the expansion of the expandable midsection (2) occurs until the collapsible midsection (2) is expanded to the form shown in FIG. 1. Referring to FIG. 3, attach the male handle connector mechanism or bead on the handle top (9) to the female handle connector mechanism or groove on the top portion rear side (10). Reversing this process would allow for the collapse of the container from its fully expanded form as shown in FIG. 1, to its fully collapsed form as shown in FIG. 4.

Once in its expanded form as shown in FIG. 3, the threaded cap (5) is removed from the threaded inlet (6) and the added liquid is dispensed into the collapsible container through the threaded inlet (6). The threaded cap (5) is then replaced and the user shakes the container to bring the added liquid and the evaporated, powdered, condensed, and concentrated product into solution. The solution may then be dispensed for use from the threaded inlet (6).

The user may remix the solution as necessary by shaking the container appropriately. The container may be used for alternative storage purposes post dispensing of the original solution. The container is ideally disposed of for recycling in its fully collapsed form. This minimizes recyclable product storage space requirements for the user and recycling facilities.

The best mode of carrying out the invention would be to utilize a blow molding process of a Food and Drug Administration approved, recyclable plastic, which would included attributes of providing ultraviolet light protection for the stored product and having the characteristic of being able to withstand frozen storage. In this configuration the collapsible container would likely have the broadest range of use and would be efficiently manufactured.

What is claimed:

1. A collapsible container formed of a rectangular top portion, a rectangular base portion, and a rectangular midsection defining side walls, said mid-section comprising a corrugated wall of horizontal corrugations along each side wall of said mid-section, said corrugated mid-section being expandable and retractable; said top portion having a centrally disposed rectangular recess extending from one end of the top portion to an opposing end, said recess having a dispensing opening formed adjacent said one end; said container including a substantially U-shaped handle having two legs interconnected by an elongated bight portion substantially the length of said recess; said top portion and base portion each having a groove adjacent the same side wall, the groove on the top portion being adjacent said opposing end, said base portion having a third groove on an opposing end of the base portion adjacent the side wall opposing said same side wall; said handle having beads located at the free end of each leg of said U-shaped handle; said beads mateable with each of the grooves such that when the corrugated mid-section is expanded, said handle engages the grooves adjacent said same side wall, and when the corrugated mid-section is retracted, said handle engages the groove on the top portion and said third groove and the bight of the handle is located in said recess.

* * * * *